US006155883A

United States Patent [19]

Chiu et al.

[11] Patent Number: 6,155,883

[45] Date of Patent: Dec. 5, 2000

[54] STRUCTURE ASSEMBLY-TYPE POWER PLUG

[75] Inventors: Kien-Chung Chiu, Taipei, Taiwan; Kwong-ming Siki Tam, Kowloon Bay, The Hong Kong Special Administrative Region of the People's Republic of China

[73] Assignees: Abacus International Co., Ltd., Taipei, Taiwan; Career Cables & Connectors Linited, Kowloon, The Hong Kong Special Administrative Region of the People's Republic of China

[21] Appl. No.: 09/243,800

[22] Filed: Feb. 3, 1999

[51] Int. Cl.[7] ..... H01R 13/502

[52] U.S. Cl. ..... 439/695

[58] Field of Search ..... 439/418, 425, 439/695

[56] References Cited

U.S. PATENT DOCUMENTS

| | | | |
|---|---|---|---|
| 3,260,985 | 7/1966 | Kindersley et al. . | |
| 4,842,546 | 6/1989 | Song | 439/409 |
| 5,041,013 | 8/1991 | Greenbaum | 439/425 |
| 5,934,930 | 8/1999 | Camps et al. | 439/425 |

*Primary Examiner*—Khiem Nguyen
*Attorney, Agent, or Firm*—Dougherty & Troxell

[57] ABSTRACT

The invention herein relates an improved stricture assembly-type power plug, specifically referring to a kind of power plug structure that can be rapidly installed without screws or soldering which has an outer shell that is fitted over an inner shell. The inner shell is of an I-shaped cross sectional profile having a center separator that is hollow with an opening at one end utilized to contain the power cord inserted through the outer shell. The too wires of the power cord are stacked vertically due to the narrow space within the center separator and, there is a channel formed on each of the exterior sides of the center separator to position the aforesaid wires. Two metal electrodes are respectively inserted in the recessed sections along the sides of the center separator and each electrode has a sharp point extending into the recessed section to pierce the covering of the power cord wires and thereby achieve direct contact with the conductors therein. There is also a nub on the exterior walls of each of the two electrodes, such that when the inner shell is inserted into the outer shell, the nubs become engaged in the catch slots on the inner walls of the outer shell to both secure and prevent the removal of the inner shell.

4 Claims, 2 Drawing Sheets

STRUCTURE ASSEMBLY-TYPE POWER PLUG

BACKGROUND OF THE INVENTION

The invention herein refers to a kind of improved structure assembly-type power plug, specifically referring to a structural assembly that is convenient to utilize because no screws or soldering is required to accomplish rapid and simple attachment to a power cord.

Conventional assembly-type power plugs, as indicated in FIG. 1, are mainly comprised of two covers (60) and (61) and two metal electrodes (62) and (63), and the two metal electrodes are positioned in slots inside the covers (60) and (61) to enable the two covers (60) and (61) to correspondingly hold the electrodes (62) and (63) within. However, in terms of actual application, this kind of design requires the fastening of the top cover (60) to the bottom cover (61) by means of inserted screws and, furthermore, the power cord (64) must be connected to the electrodes (62) and (63) with screws or by soldering, which necessarily involves the use of tools to complete assembly. If there are no tools at the installation site or the user is unable to utilize tools, the result would be confusion, inconvenience, and perhaps even preclude successful installation and, furthermore, the utilization of screws and soldering requires a longer installation time.

In view of the foregoing situation, the inventor of the invention herein decided to innovate improvements to overcome the existent drawbacks of the conventional products, and following extensive thought and research, and based many years of experience in such product development, the efforts of the aforesaid inventor finally culminated in the invention herein.

SUMMARY OF THE INVENTION

Therefore, the primary objective of the invention herein is to provide a kind of improved structure assembly-type power plug, the structural and electrical assembly of which does not require the utilization of screw or soldering tools, but is accomplished manually in a procedure that is not only extremely rapid and uncomplicated, but also does not require reliance on any tools whatsoever to allow simple assembly without tools and by persons unable to utilize tools.

To enable a further understanding of the structure and innovations of the invention herein, the brief description of the drawings below are followed by the detailed description of the invention herein.

PARTS OF THE DRAWINGS

| | | |
|---|---|---|
| 60, 61-Cover. | 62, 63, 3, 4-Metal electrode. | 64, 5-Power cord. |
| 1-Outer shell. | 2-Inner shell. | 10-Opening. |
| 11-Insertion hole. | 12, 14-Guide groove. | 13-Catch slot. |
| 22, 23-Recess sections. | 21-Center separator. | 210-Hollow passage. |
| 211, 212-Dividing ridge. | 213, 214-Channels. | 215, 216-Guide rail. |
| 221, 231-T-shaped edifice. | 31, 41-C-shaped edifice. | 32, 42-Indentation. |
| 33, 43-Plug prong. | 311, 411-Hook. | 312, 412-Sharp points. |
| 321, 421-Nub. | | |

DETAILED DESCRIPTION OF THE INVENTION

Figure 2:
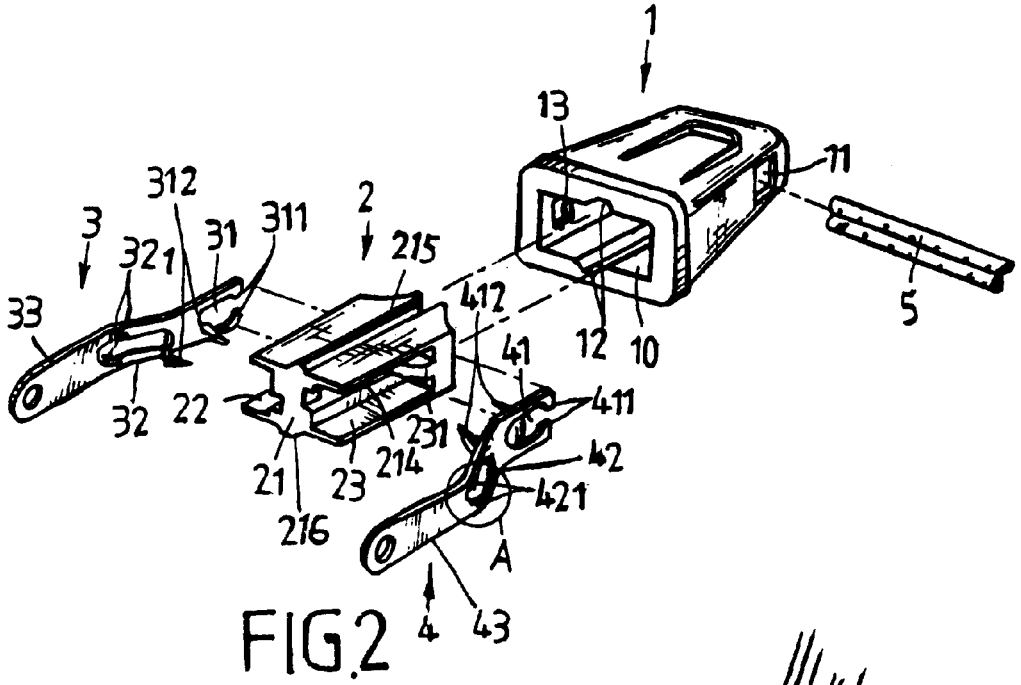
FIG. 2 is an isometric exploded drawing of the invention herein.

Referring to FIG. 2, the invention herein is mainly comprised of an outer shell (1), an inner shell (2), and two metal electrodes (3) and (4), of which the outer shell (1) is hollow, constricted of an insulative material, and resembles a trapezoid and, furthermore, has an opening (10) at the exterior end that accommodates the entry of the inner shell (2) and has an insertion hole (11) through the lateral interior wall for the insertion of a power cord (5), wherein along each of the two corresponding top and bottom interior walls of the opening (10) are the guide grooves (12) and (14), and on each the two corresponding left and right interior walls (near the surface of the opening) is a catch slot (13).

Figure 5:
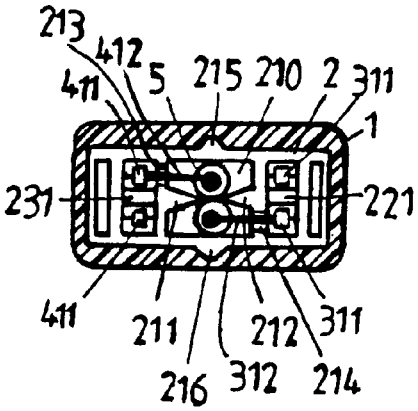
FIG. 5 is a cross-sectional assembly drawing of the invention herein.
Figure 4:
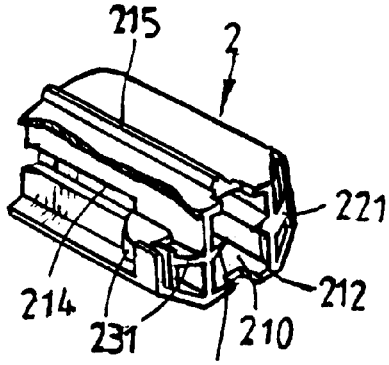
FIG. 4 is a cross-sectional drawing of the shell of the invention herein, depicting the interior from another angle of perspective.

The inner shell (2) consists of a rectangular insulative body having an I-shaped cross-sectional profile that fits into the outer shell (1) that has a lengthwise center separator (21) with a recess section (22) and (23) along both the left and right sides; the center separator (21) is not solid and, furthermore, has an open-ended hollow passage (210) formed inside for containing the power cord (5); as indicated in FIG. 4 and FIG. 5, the aforesaid hollow passage (210) has a height-to-width ratio of approximately 2:1 and, furthermore, has elevated dividing ridges (211) and (212) that extend lengthwise along the left and right sides, respectively, that enable the two wires of the power cord (5) to be positioned in a stacked vertical manner within the hollow passage (210). Furthermore, there are channels (213) and (214) along both the left and right sides, respectively, of the center separator (21) that are appropriately positioned facing the power cord (5), enabling the correct alignment of the power cord (5) by the two channels (213) and (214). Furthermore, protruding respectively from the top surface and bottom surface of the aforesaid inner shell (2) are guide rails (215) and (216) that are aligned with the guide grooves (12) and (14) of the outer shell (1), and along the interior lateral ends of the two recess sections (22) and (23) of the inner shell (2) are the T-shaped edifices (221) and (231) and, furthermore, the horizontal flat sections are of a tapered designed in that the outer side is wide and the inner side is thin, while one side of the vertical flat section is contiguous with the top and bottom surface of the inner shell (2) to form the upper and lower aspects, respectively, of the two channels (213) and (214), which is where the point of connection to the two metal electrodes (3) and (4) is located.

The aforementioned electrodes (3) and (4) consists of three sections that are formed by bending, with the C-shaped edifices (31) and (41) at the innermost section, the indentations (32) and (42) at the center section, and the plug prongs

Figure 1:
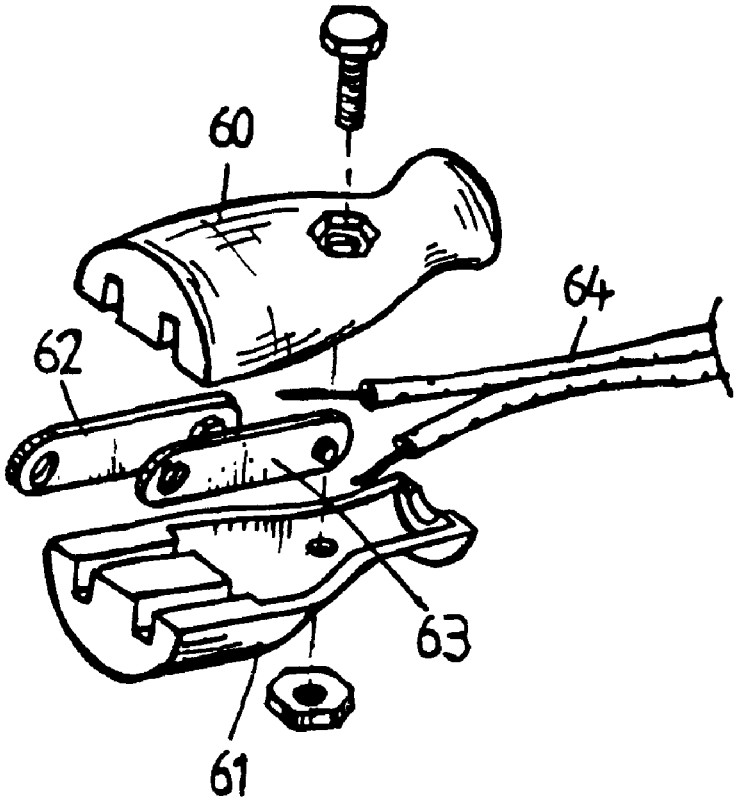
FIG.1(PRIOR ART)
FIG. 1 is an isometric exploded drawing of a conventional assembly-type power plug.
Figure 6:
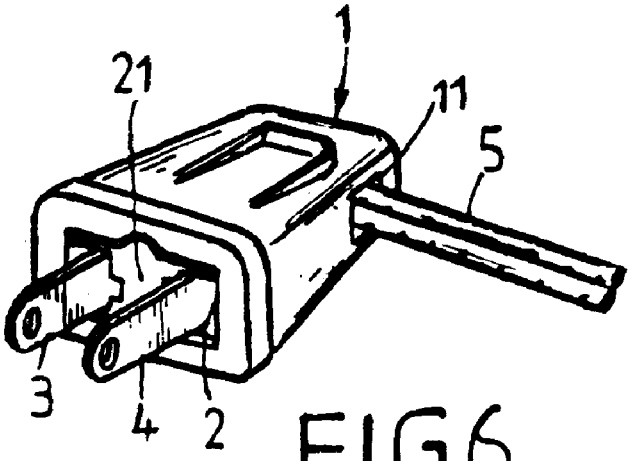
FIG. 6 is an isometric assembly drawing of the invention herein.
Figure 3:
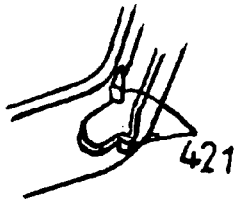
FIG. 3 is a magnified view of section A in FIG. 2.

(33) and (43) at the partially exposed outer section, and the C-shaped edifices (31) and (41) have the hooks (311) and (411) at the open ends that are inserted into channels (213) and (214) formed by the T-shaped edifices (221) and (231) of the inner shell (2), with the aforesaid hooks (311) and (411) clipping onto the taper of the thick flat section to prevent the electrodes (3) and (4) from being dislodged, while allowing for an outward movement range of 30 degrees and, furthermore, there are sharp points (213) and (214) aligned with the C-shaped edifices (31) and (41) facing the channels (213) and (214) of the inner shell (2), such that when the electrodes (3) and (4) are in a parallel state, the aforesaid sharp points (213) and (214) extend into the channels (213) and (214), and the nubs (321) and (421) protruding from the two electrodes (3) and (4) are appropriately positioned in the catch slots (13) of the outer shell (1); as indicated in FIG. 3, since the power cord is situated in the hollow passage (210) and, furthermore, held in position by the dividing ridges (211) and (212), when the plug prongs (33) and (43) of the electrodes (3) and (4) are rotated away from the center separator (21) and into a parallel state, the two sharp points (312) and (412) are pushed into the channels (213) and (214) and pierce the covering of the power cord (5), thereby establishing direct contact with the conductors of the power cord (5); in the assembly procedure of the invention herein, the outer shell (1) is first separated from the inner shell (2) and the power cord (5) is inserted into the insertion hole (11), then, with the two electrodes (3) and (4) kept apart, the power cord (5) is inserted into the hollow passage (210) of the inner shell (2), following which the two electrodes (3) and (4) are squeezed inward into a parallel state, causing the sharp points (312) and (412) to pierce the covering of the power cord (5) and achieve continuity with the conductors, and finally the completed inner shell (2) is inserted into the outer shell (1) and, furthermore, the guide rails (215) and (216) of the inner shell (2) are placed into the guide grooves (12) and (14) of the outer shell (1) that provides for mounting and direction, and when the inner shell (2) is pushed up to the dead point, the nubs (321) and (421) of the two electrodes (3) and (4) are engage the catch slots (13) on the two interior sides of the outer shell (1), which prevents the further removal of the inner shell (2) from the outer shell (1) and completes the assembly procedure; as indicated in FIG. 6, the assembly procedure is extremely simple and rapid and, furthermore, does not require the utilization of any tools whatsoever to accomplish.

What is claimed is:

1. A power plug that is comprised of an outer shell that is hollow, constructed of an insulative material, and which has an opening at an exterior end that accommodates entry of an inner shell and an insertion hole through a lateral wall for the insertion of a power cord; an inner shell having a rectangular insulative body with an I-shaped cross sectional profile that fits into the outer shell which has a lengthwise center separator with a recess section along both left and right sides; the center separator has an open-ended hollow passage formed inside that contains a power cord, and the hollow passage has a height-to-width ratio of approximately 2:1 and has elevated dividing ridges that extend lengthwise along left and right sides, respectively, that enable two wires of the power cord to be positioned in a stacked vertical manner within the hollow passage and a channel along both the left and right sides of the center separator that are positioned facing the power cord, enabling the correct alignment of the power cord by the two channels; two guide rails protruding from top and bottom surfaces of the inner shell that are aligned with the guide grooves; along interior lateral ends of the two recess sections of the inner shell are two T-shaped edifices, horizontal flat sections of the T-shaped edifices have a tapered configuration in which an outer side is wide and an inner side is thinner, one side of a vertical flat section is contiguous with the top and bottom surfaces of the two channels; two electrodes that each consist of three sections, such that there are two C-shaped edifices at an innermost section, two indentations at a center section, and two plug prongs at a partially exposed outer section, and the two C-shaped edifices each having hooks at open ends that are inserted into the aforesaid channels formed by the T-shaped edifices of the inner shell, with the hooks clipping onto the taper of a thick flat section to prevent removal of the electrodes, while allowing for a fixed range of outward movement, furthermore, there are sharp points aligned with the C-shaped edifices facing the channels of the inner shell, such that when the two electrodes are in a parallel state, at least one of the sharp points extend into each of the two channels and pierce the covering of the power cord, thereby establishing direct contact with conductors of the power cord.

2. The power plug of claim 1 further comprising a guide groove extending lengthwise along each of the two facing interior walls of the outer shell; and a guide rail protruding from both the top surface and bottom surface of the inner shell.

3. The power plug of claim 1 further comprising a catch slot situated on each of the two interior walls of the outer shell and a nub protrudes from each of the two electrodes, such that, when the inner shell is inserted into the outer shell up to a dead point, the nubs engage the catch slots, which prevents the further removal of the inner shell from the outer shell.

4. The power plug of claim 1, wherein the power cord is positioned by dividing ridges that extend lengthwise along both left and right sides of the hollow passage through the center separator.

* * * * *